United States Patent [19]

Cardellini

[11] 4,349,290

[45] Sep. 14, 1982

[54] LOOSE LEAF BINDER

[76] Inventor: Claudio B. Cardellini, Rua Manuel Maria Tourinho, 673, 01236 Sao Paulo SP, Brazil

[21] Appl. No.: 131,766

[22] Filed: Mar. 19, 1980

[30] Foreign Application Priority Data

Mar. 21, 1979 [BR] Brazil ..... 7901760[U]

[51] Int. Cl.[3] ..... B42F 3/02; B42F 13/22

[52] U.S. Cl. ..... 402/55; 402/46

[58] Field of Search ..... 402/46, 48, 55, 56

[56] References Cited

U.S. PATENT DOCUMENTS

| | | | |
|---|---|---|---|
| 1,000,649 | 8/1911 | Walker | 402/55 |
| 2,555,534 | 6/1951 | Emmer et al. | 402/55 |
| 2,598,044 | 5/1972 | Emmer | 402/55 |
| 3,833,308 | 9/1974 | Seaborn | 402/56 |

*Primary Examiner*—Paul A. Bell
*Assistant Examiner*—John S. Brown
*Attorney, Agent, or Firm*—Cushman, Darby & Cushman

[57] ABSTRACT

A loose leaf binder is formed from two main parts, which have cooperating half-rings and are interconnected by wire links. The cooperating half-rings of the binder have a mating locking mechanism at their free ends.

The binder's opening is achieved through relative displacement, in longitudinal and transverse directions, of its main parts. A movable clip, placed at an end of the binder, prevents the relative displacement of the main parts when the binder is closed.

4 Claims, 5 Drawing Figures

FIG. 3
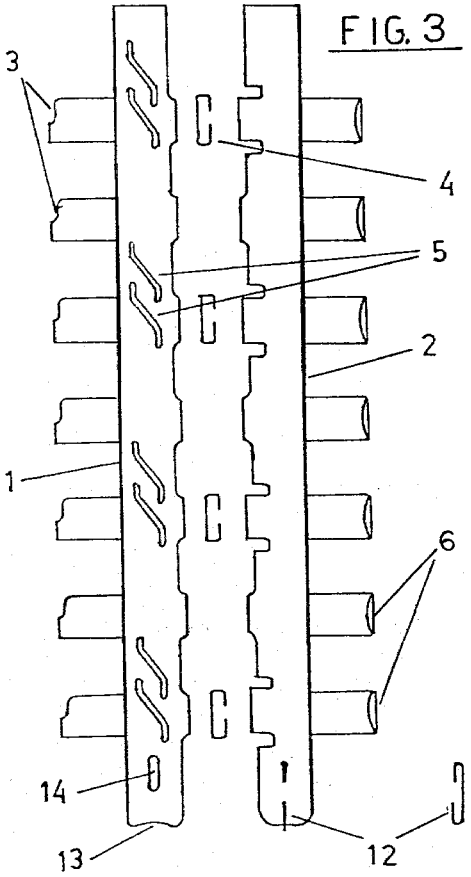
FIG. 4
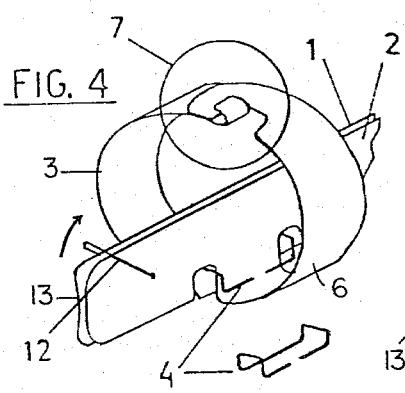
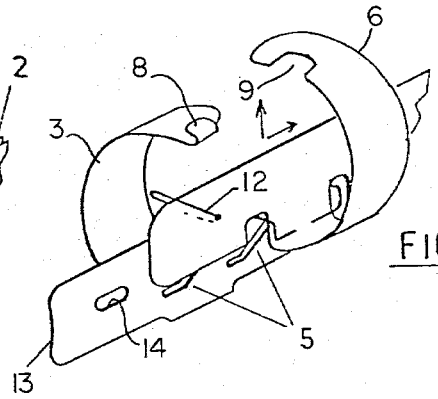
FIG. 5

LOOSE LEAF BINDER

This invention relates to a loose leaf binder.

Prior references are: U.S. Patent applications Ser. Nos. 26,682 and 35,080, filed respectively on Mar. 19, 1979 and May 1, 1979, and now abandoned.

There are attached hereto drawings of this invention:

FIG. 3 illustrates an exploded view of the binder, to permit better visualization of its components parts; and FIGS. 4 and 5 are perspective views of portions of the binder shown in closed and open portions, respectively.

Figure 1:
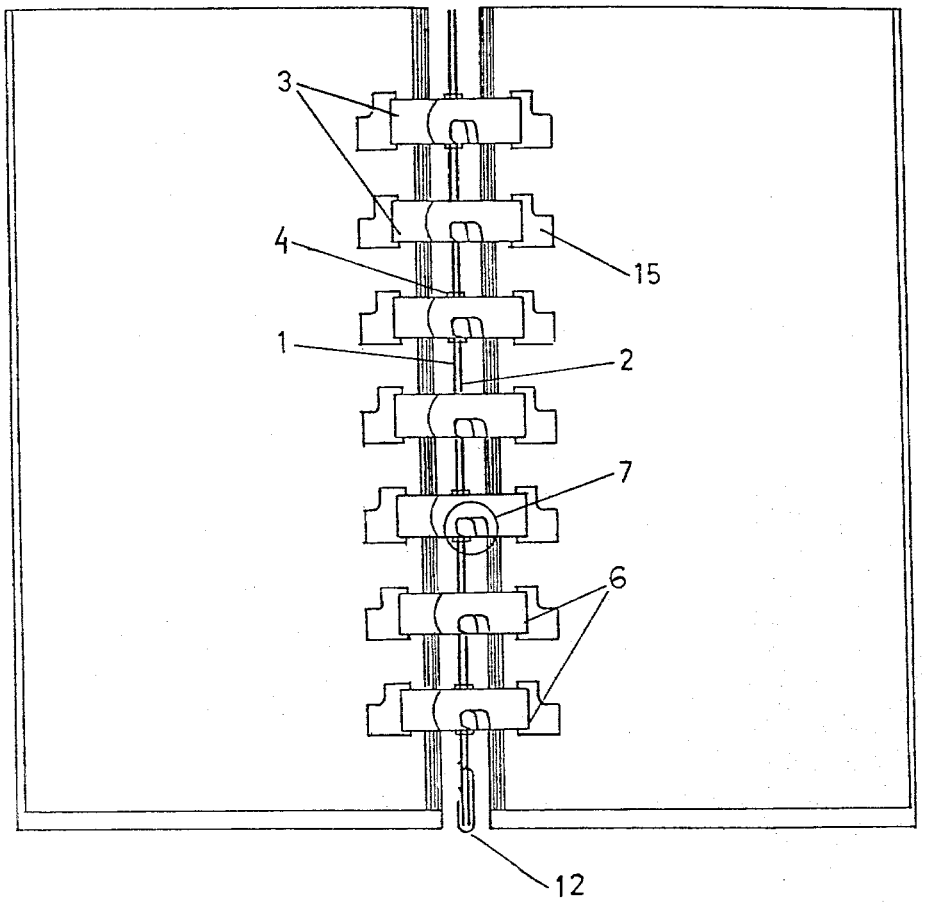
FIG. 1 is a top plan view of the binder carrying sheets of paper, the binder being shown in its closed position.

The binder is made of two thin cut elongated strips 1, 2 partially arcuated, the curved portions of said strips 1, 2 constituting a series of spaced half-rings 3 and 6, respectively.

The connection between strips 1, 2 is obtained by means of linking rings 4. Each ring 4 is formed by a metallic wire curved as illustrated in FIG. 4.

The strip 1 has pairs of inclined slots 5 in its flat part and positioned in correspondence to each, or at least some of its half rings 3.

Figure 2:
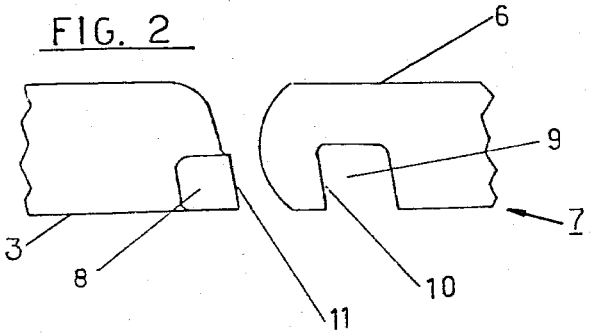
FIG. 2 is a detailed view of that portion of the binder used for locking purposes.

Each ring 4 has its spaced arms inserted in a pair of inclined slots 5 and its open, spaced ends within a corresponding half ring 6 of the strip 2. Each pair of cooperating half-rings 3, 6 of the binder has at its free ends a locking mechanism illustrated generally in FIG. 4. FIG. 2 is an elongated top view of the locking meachanism 7 showing the ends of the half-rings 3, 6 separated.

The locking mechanism 7 is made up of a loop 8, placed at the free end of each half-ring 3 of the strip 1, which is adapted to be received in a corresponding notch 9 positioned at the free end of each half-ring 6 of the strip 2.

For improved interlocking of each pair of corresponding half-rings 3, 6, an edge 10 of the notch 9, as well as the direction of the fold 11 of the loop 8, are inclined relative to the longitudinal axes of the strips 1, 2.

The strip 2 has pivotally joined to one of its ends a small clip 12, made from a thin metallic aire and curved in a C-shape as shown in FIG. 3. The clip 12 serves to prevent the displacement of the strip 1 relative to the strip 2, when the binder is in closed position.

More, paritcularly, the flat part of the strip 1 has a slight recess 13 in its end to accept the free end of the clip 12 when the binder is in closed position. Adjacent to this end of strip 1 there is provided a hole 14 (or alternatively, a recess in strip 1), intended to receive the pivotally mounted end of the clip 12, when the binder is in closed position.

To open the binder it is enough to pivot and disengage the clip 12 from recess 13, as indicated in FIG. 4, and to push the strip 2 lengthwise in the direction of separation of notch 9 from loop 8 of the locking mechanism 7. When the strip 2 is so moved, the arms of ring 4 move along teh slots 5 of strip 1 thus elevating strip 2 relative to strip 1 separating the pairs of corresponding half-rings 3, 6, as illustrated in FIG. 5. By rotating the strip 2 relative to the strip 1 about its longitudinal axis, the binder shall opens, thus permitting the insertion or removal of sheets. To close the binder the above described procedure is reversed.

The holes 15 of the sheets to be used in this binder must be shaped to permit relative longitudinal movement of strips 1 and 2. Preferably, the configuration is "L" shape with a portion of each hole 15 substantially corresponding to the spacing of the end of the loop 8 from half-ring 3 so as to factilitate movement of the binder's sheets past the loop.

What I claim is:

1. A loose leaf binder comprising:

a pair of elongated strips each having a plurality of half-rings at corresponding spaced locations along an edge thereof;

means provided at the ends of said half-rings to permit a half-ring associated with one strip to interlock with a half-ring associated with the other strip to form a full ring when the rings are positioned in juxtaposition;

a plurality of linking rings hingedly interconnecting said strips, each of said linking rings extending through a separate pair of parallel slots provided in one of said strips, said slots being inclined with respect to the longitudinal axes of said strips whereby during relative longitudinal movement between the strips, movement of the linking rings within said slots also displaces said strips transversely with respect to one another to release by longitudinal and elevational displacement the half-rings of one strip from interlocking relationship with the half loops of the other strip.

2. A loose leaf binder as set forth in claim 1 wherein:

said interlocking means comprises a loop formed in the free ends of the half-rings associated with one of said strips and notches located adjacent the free ends of the half-rings associated with the other of the strips.

3. A loose leaf binder as set forth in claim 2, wherein each of the loops has a direction of fold inclined to the longitudinal axis of its associated strip and each notch has a loop-engaging edge similarly inclined with respect to the longitudinal axis of its associated strip.

4. A loose leaf binder as set forth in claim 1, 2 or 3, further comprising:

a C-shaped clip pivotally joined to an end of one of said strips and adapted to be received by the end of the other strip to prevent relative longitudinal movement between the strips when the half-rings are interlocked.

* * * * *